US005882377A

United States Patent [19]

Aida et al.

[11] Patent Number: 5,882,377

[45] Date of Patent: Mar. 16, 1999

[54] PROCESS FOR SMELTING REDUCTION OF CHROMIUM ORE

[75] Inventors: Kimiharu Aida; Shuji Takeuchi; Nagayasu Bessho; Tomomichi Terabatake; Yasuo Kishimoto; Hiroshi Nishikawa; Fumio Sudo, all of Chiba, Japan

[73] Assignee: Kawasaki Steel Corporation, Japan

[21] Appl. No.: 793,687

[22] PCT Filed: Sep. 27, 1996

[86] PCT No.: PCT/JP96/02813

§ 371 Date: Mar. 5, 1997

§ 102(e) Date: Mar. 5, 1997

[87] PCT Pub. No.: WO97/12066

PCT Pub. Date: Mar. 4, 1997

[30] Foreign Application Priority Data

Sep. 28, 1995 [JP] Japan ..... 7-250826
Dec. 13, 1995 [JP] Japan ..... 7-324522

[51] Int. Cl.[6] ..... C21B 13/00

[52] U.S. Cl. ..... 75/623; 75/611; 75/585; 75/392; 75/414; 75/433

[58] Field of Search ..... 75/623, 611, 585, 75/392, 414, 433

[56] References Cited

U.S. PATENT DOCUMENTS 3,383,199 5/1968 Schmidt ..... 75/4
3,993,471 11/1976 Yoshimura et al. ..... 75/3
4,565,574 1/1986 Katayama et al. ..... 75/130.5
4,765,828 8/1988 Nehls, Jr. et al. ..... 75/10.19
4,961,784 10/1990 Tanabe et al. ..... 75/623

FOREIGN PATENT DOCUMENTS 0599773A 6/1994 European Pat. Off. ..... C04B 35/04
50-66395W 6/1975 Japan ..... C22B 34/32
01162714A 6/1989 Japan ..... C21C 5/44
03271310 3/1991 Japan ..... C21B 11/02

*Primary Examiner*—Patrick Ryan
*Assistant Examiner*—M. Alexandra Elve
*Attorney, Agent, or Firm*—Austin R. Miller

[57] ABSTRACT

In this invention, the smelting reduction operation can be carried out in a high efficiency by charging a carbonaceous material in such an amount that total surface area is not less than 60 $m^2$ per 1 ton of slag weight. Carbon substance finely particulating through thermal crumbling under a high-temperature atmosphere inside the vessel is used as the carbonaceous material, whereby it is possible to stably conduct the smelting reduction while controlling the scattering of the carbonaceous material, and also the erosion, particularly locally erosion of refractory in the smelting reduction furnace, which was a serious problem in the conventional technique, can considerably be decreased to largely prolong the service life of refractory.

14 Claims, 8 Drawing Sheets

PROCESS FOR SMELTING REDUCTION OF CHROMIUM ORE

TECHNICAL FIELD

This invention relates to a smelting reduction process of chromium ore, and more particularly to a process for directly using a cheap chromium ore instead of an expensive alloying iron to attain stable smelting reduction in a high efficiency.

BACKGROUND ART

Heretofore, the production of stainless steel has been carried out by using ferrochromium obtained through carbon reduction of chromium ore or the like in an electric furnace. However, the production of the ferrochromium was necessary to take a greater amount of electric power and the production cost thereof became high and hence the production cost of the stainless steel became also high.

As a countermeasure for solving the above problem, there has been developed so-called smelting reduction process in which chromium ore or unreduced or semi-reduced pellets of the chromium ore subjected to a preliminary treatment are subjected to carbon reduction in a metallurgical reaction vessel such as a convertor or the like without using electric power to prepare a chromium-containing molten metal (for example, JP-A-58-9959 and JP-A-55-91913).

However, the aforementioned smelting reduction process of chromium ore has still the following problems.

1) The chromium ore contains a great amount of gangue ingredient (MgO, $Al_2O_3$ and so on), while the gangue ingredient is included in fuel and a carbonaceous material as a reducing agent, so that a greater amount of slag is created during the smelting reduction.
2) In addition to the great amount of the slag, if the reduction reaction efficiency is low, the refractory is considerably lost by a metal oxide ingredient ($Cr_2O_3$, FeO) having a high oxidizing property and also the smelting time becomes longer.
3) When the carbonaceous material is charged in only a necessary amount calculated from carbon balance and heat balance, slag foaming and slopping are caused and hence the operation becomes unstable.
4) Therefore, an excessive amount of the carbonaceous material is charged in the smelting reduction.

However, when the carbonaceous material is excessively used, the amount of carbon remaining in the slag becomes large after the completion of blowing, which brings about the lowering of the utilization of the carbonaceous material and also badly exerts on the effective use of the slag.

DISCLOSURE OF THE INVENTION

It is an object of the invention to advantageously solve the aforementioned problems and to provide a smelting reduction process of chromium ore in which (1) the increase of the slag amount can be controlled, (2) the reduction reaction efficiency in the chromium ore can be improved to attain the mitigation of refractory erosion, reduction of operating time and stabilization of operation, and (3) it is possible to effectively use the slag at the smelting reduction step, and hence chromium-containing molten metal can cheaply and efficiently be obtained as a base melt of stainless steel.

That is, the essentials and constructions of the invention are as follows.

1. A smelting reduction process of chromium ore by charging a carbonaceous material and a chromium ore into hot metal admitted in a metallurgical reaction vessel such as a converter or the like, feeding an oxygen gas to burn the carbonaceous material and conducting fusion and reduction of the chromium ore through heat of combustion to produce a chromium-containing molten metal, characterized in that a carbon substance having a Hardgrove grindability index (HGI) of not more than 45 and a volatile matter (VM) of not more than 10% is used as the carbonaceous material.
2. A smelting reduction process according to the item 1, wherein the carbonaceous material charged in the metallurgical reaction vessel has such a particle size formation that a ratio of particle size larger than a given particle size (dp) calculated from the following equation (1) is not less than 80%:

$$dp=0.074\cdot((Q+0.04\cdot VM\cdot W)/D^2)^{2/3}\ (mm) \quad (1)$$

wherein VM: volatile matter in carbonaceous material (%)
W: feed rate of carbonaceous material (kg/min)
Q: rate of generating ($CO+CO_2$) from an inside of a vessel resulted from the supply of oxygen ($Nm^3$/min)
D: opening diameter of a vessel (m).

3. A smelting reduction process according to the item 1 or 2, wherein the carbonaceous material is charged into the metallurgical reaction vessel in an amount that a total surface area of the carbonaceous material charged is not less than 60 $m^2$ per 1 ton of slag existing in the vessel.
4. A smelting reduction process according to the item 1, 2 or 3, wherein a portion of the carbonaceous material having a particle size smaller than the particle size calculated by the equation (1) is agglomerated.
5. A smelting reduction process according to the item 1, 2, 3 or 4, wherein the reaction vessel is a converter using MgO-C bricks having a C content of 8–25% in at least a part of a portion of the vessel contacting with the slag.
6. A smelting reduction process according to the item 1, 2, 3, 4 or 5, wherein a post combustion ratio inside the reaction vessel is not more than 30%.

The invention will concretely be described below.

The inventors have made studies on smelting reduction states using various kinds of carbonaceous materials in a small-size melting furnace for more detailedly investigating the influence of the carbonaceous material upon the smelting reduction.

As a result, it has been confirmed that the reduction reaction efficiency of the chromium ore is improved as the carbon substance having less gangue ingredient and less volatile matter is used.

Then, the inventors have made experiments of actually charging the above carbon substances into carbon-saturated molten metal in order to clarify the above reason.

Consequently, it has been found that good results are particularly obtained when the carbon substance charged is thermally crumbled to form fine particles.

That is, it has been found that the increase of reaction surface area in the carbonaceous material finely pulverized by thermal crumbling after the charging into the vessel is very effective to the improvement of the reduction reaction efficiency at the smelting reduction step.

In FIG. 1 are shown results investigated on a relation between total surface area of carbonaceous material just after the smelting reduction per 1 ton of slag (values measured considering particle size distribution) and a total chromium concentration (T.Cr) in the slag.

As seen from FIG. 1, the reduction reaction is promoted as the reaction surface area of the carbonaceous material increases irrespectively of the kind of the carbonaceous material used and hence the Cr concentration in the slag decreases after the completion of the smelting reduction.

Thus, the reduction of chromium from molten slag with the carbonaceous material can be represented by the total surface area of the carbonaceous material. When the total surface area is not less than 60 $m^2$ per 1 ton of slag, T.Cr in the slag is not more than 1%, from which it is understood that approximately 100% of reduction is attained.

In the invention, therefore, the total surface area of the carbonaceous material is restricted to not less than 60 $m^2$ per 1 ton of slag weight.

Moreover, in order to attain the feature that the total surface area is not less than 60 $m^2$ per slag weight (1 ton) as mentioned above, it is necessary to always supply the carbonaceous material considering that the carbonaceous material charged is momentarily consumed by the reduction reaction with oxygen concurrently charged and chromium oxide existing in the slag. That is, it is important to control the feed rate of the carbonaceous material so as to always keep the above condition by determining oxygen feed rate and carbon feed rate in accordance with comprehensive heat balance and mass balance considering reaction heat of carbon combustion (primary and post combustions), reduction endotherm of chromium oxide and the like.

Now, the particle size of the carbonaceous material is significant in the charging of the carbonaceous material because when the particle size is small, the yield of the carbonaceous material charged in the vessel lowers.

Since the inside of the vessel for the smelting reduction is a very high temperature, the carbonaceous material charged is violently heated to rapidly gasify the volatile matter included therein. The resulting gas is added to CO and $CO_2$ gases produced by primary and post combustions of the carbonaceous material, whereby the gas flowing rate at the opening of the vessel is increased and hence the scattering ratio of the carbonaceous material toward the outside of the vessel is increased to lower the yield of the carbonaceous material. This tendency is remarkable as the particle size becomes smaller.

On the other hand, when the particle size is large, there is no problem in the yield. However, in order to realize the aforementioned total surface area, it is required to use a vast amount of the carbonaceous material as compared with the case of using fine particles of the carbonaceous material. As a result, a greater amount of carbon remains in the slag after the blowing, so that the wasteful amount of the carbonaceous material increases and also the effective utilization of the slag is not attained.

In this connection, when the carbonaceous material has a particle size not scattered by the gas flowing out from the vessel opening in the charging into the vessel and is finely particulated by thermal crumbling after the charging, there is caused no problem in the yield and the required carbon amount and hence the smelting reduction can efficiently be attained.

Therefore, the inventors have made further studies with respect to various kinds of the carbonaceous materials in order to find ones satisfying the above properties.

At first, when the investigation is made with respect to general-use coals, it has been confirmed that only the volatile matter in the general-use coal expands and the thermal crumbling is not particularly caused.

Then, when coke is examined, it has been confirmed that gas ingredients such as hydrogen and the like included in coal evaporate at a carbonization step of the coal being the production step of coke and hence the porosity of the coke becomes high but the gangue ingredient included in the coal such as $SiO_2$, $Al_2O_3$ or the like acts as an aggregate to cause no thermal crumbling.

On the other hand, relatively dense coals having less gangue ingredient and less volatile matter are small in the volume of gas evaporating course as compared with the general-use coal and less in the aggregate ingredient, so that it has been found out that when these coals are exposed to a high-temperature atmosphere, they are rapidly heated to cause violent expansion of the volatile matter or steam and hence the thermal crumbling is easily caused when the volatile matter or steam comes out from the system.

When such a carbon substance is used as a carbonaceous material for the smelting reduction, it is thermally crumbled in the vessel to increase the surface area of the carbonaceous material for the reduction reaction and hence the reduction reaction efficiency is improved.

Further, the investigation on the erosion mechanism and rate of the refractory through slag is carried out when chromium ore is charged into a small-size testing converter. As a result, when the chromium ore is charged from a chromium charging lance, it has generally been considered that the ore descends straightward in form of particle groups instead of single particle form without being substantially affected by an ascending gas flow as shown in FIG. 2 and goes into the slag, and then the chromium ore is dissolved in the slag and reduced by the carbonaceous material included in the slag. In fact, however, it has been confirmed that as shown in FIG. 3, a part of the ore arrives at a refractory wall and oxides, particularly iron oxide included in the ore reacts with carbon of the refractory to promote erosion of MgO-C brick. Moreover, it has been confirmed that such an excessively oxidized state of the slag becomes extremely large under a condition that a post combustion ratio of a top-blown lance is high.

In FIGS. 2 and 3, numeral 1 is a converter, numeral 2 a top-blown lance, numeral 3 a chromium charging lance, and numeral 4 a coal.

Therefore, the feature that the reduction of chromium in the slag is promoted is effective to not only improve the reduction reaction efficiency but also reduce the erosion of the refractory.

Then, as the properties were investigated with respect to the coals exhibiting the considerable improving results, it has been found out that the carbon substance satisfying that a Hardgrove grindability index (HGI) defined by JIS M8801 is not more than 45 and a volatile matter (VM) in the carbon substance is not more than 10% are effective as a carbonaceous material to improve the reduction reaction efficiency of the chromium ore and the service life of the refractory.

The term HGI is defined according to JIS M8801 and is an indication of grindability, which is calculated by substituting an undersize mass (W) after a given sample (powder having a particle size of about 1 mm: about 50 g) is pulverized in a Hardgrove testing machine and sieved through a given sieve (74 $\mu$m) for the following equation:

$$HGI=13+6.93W$$

In order to search a cause that the above coal exhibits the considerable improving effects, coal 4 is charged from a hopper above the converter as shown in FIG. 3 and then the sampling is carried out from gas in the converter.

FIG. 4(*a*) shows a particle size distribution of the coal before the charging, while FIG. 4(*b*) shows a particle size distribution of the coal recovered from the gas in the converter after the charging.

As seen from these figures, the coal satisfying the above conditions is rapidly and finely particulated in the converter after the charging into the converter.

The similar experiment is carried out with respect to coke having a low reduction reaction ratio and carbon substances having HGI of more than 45. As a result, the particle size is slightly decreased before and after the charging, but the thermal crumbling is not observed.

Firstly, the coal having HGI of not more than 45 and VM of not more than 10% is finely particulated through the thermal crumbling after the charging into the converter to increase the reaction surface area being most important in the reduction reaction. Therefore, it is considered that the reduction reaction efficiency is improved at the smelting reduction step.

Secondly, a part of the thermally crumbled coal makes the reduction of $CO_2$ formed through post combustion in the converter to lower the gas temperature. Therefore, it is considered that the lowering of the gas temperature through the reduction of $CO_2$ mitigates the erosion of the refractory together with the rapid reduction of the metal oxide in the slag as previously mentioned.

Moreover, the similar experiment was carried out with respect to general-use coal having HGI of not more than 45 and VM of about 30%. As a result, the fine particulation is observed after the charging but there are caused the following problems in the operation.

Firstly, the scattering of the carbonaceous material into dust increases and the charging efficiency becomes extremely poor. As a result, the carbonaceous material remaining in the slag decreases and the reduction reaction efficiency of the ore lowers. This is considered due to the fact that when VM is high, the reaction of the volatile matter proceeds in a moment of charging the carbonaceous material into the converter and hence the amount of waste gas rapidly increases to increase the scattering of the carbonaceous material into the outside of the system.

Secondly, the service life of the refractory is considerably degraded. This is considered due to the fact that when VM is high, the temperature of waste gas rises and particularly the temperature of the slag surface is raised accompanied with the increase of post combustion ratio.

According to the invention, therefore, coals satisfying the volatile matter (VM) of not more than 10% and HGI of not more than 45, which are finely particulated in the gas inside the converter through thermal crumbling in a moment of charging into the converter, are used as the carbonaceous material.

Moreover, when using coal having HGI of more than 45 , the improvement of the service life of the refractory cannot be expected. From a fact that thermal cracking of the carbonaceous material is not caused as confirmed in the sampling of waste gas, it is considered that the coal does not cause the thermal crumbling until it contacts with slag·metal and hence the effect of lowering the temperature of the waste gas is not obtained.

And also, the slag foaming and slopping at the smelting reduction step mainly result from the poor reduction of molten slag. In this case, the force causing the problem is CO gas produced by the reaction between molten slag having a high oxidizing property and [C] in metal. Therefore, if the reduction of molten slag is promoted by the carbonaceous material, the oxidizing property of the molten slag is lowered and hence the above problem can be controlled.

Heretofore, the addition of excessive carbonaceous material to molten slag has been taken as the countermeasure. If the reactivity of the carbonaceous material itself is enhanced as defined in the invention, the reduction of molten slag is promoted, whereby the unit of the carbonaceous material is cut and also the amount of carbon remaining in the slag is decreased after the blowing, so that it is possible to effectively utilize the slag.

As the oxidizing property of the slag lowers at the smelting reduction step, the erosion of the refractory is mitigated and the inclusion of MgO as a main raw material of the refractory into the slag is controlled, which develop an effect of preventing the expansion of the slag in the reutilization of the slag after the treatment of the smelting reduction.

As mentioned above, when using the carbonaceous material having a certain particle size in the charging and being finely particulated after the charging, the total surface area of the carbonaceous material in the slag increases, so that the reduction reaction efficiency can be improved and hence the extension of the refractory life and the prevention of the slag foaming and slopping can be attained.

Then, the inventors have examined the particle size of the carbonaceous material not scattering in the charging.

As a physical factor determining the scattering ratio of the carbonaceous material, there are the particle size of the carbonaceous material and the gas flowing rate at the opening of the vessel. The gas flowing rate is determined by the amount of gas generated and the area of the vessel opening. On the other hand, the amount of gas generated is obtained by considering a gas produced by the gasification of the volatile matter in the carbonaceous material in addition to CO and $CO_2$ gases produced by primary combustion and post combustion resulted from the supply of oxygen.

After various examinations were carried out on the particle size of the carbonaceous material not scattered at a gas flowing rate in the vessel opening determined by operating conditions, the following equation is (1) has been induced:

$$dp=0.074\cdot((Q+0.04\cdot VM\cdot W)/D^2)^{2/3}\ (mm) \quad (1)$$

wherein VM: volatile matter in carbonaceous material (%)

W: feed rate of carbonaceous material (kg/min)

Q: rate of generating ($CO+CO_2$) from an inside of a vessel resulted from the supply of oxygen ($Nm^3$/min)

D: opening diameter of a vessel (m).

In FIG. 5 are shown results measured on a relation between a ratio of particle size larger than the above dp as an indication and a yield of the carbonaceous material added [(total amount of carbonaceous material charged−amount of carbonaceous material scatter)/(total amount of carbonaceous material charged)].

As seen from FIG. 5, when the ratio of particle size larger than dp is not less than 80%, the yield of the carbonaceous material is considerably improved.

Although the reason is not clear, it is considered that when the ratio of small particle size exceeds a certain extent (not less than 20% in this case), the ratio of carrying away the carbonaceous material with the waste gas in a smoke duct before the arrival to the opening of the vessel increases and the like. Therefore, when the particle size of the carbonaceous material is selected by using the above equation in accordance with the volatile matter of the carbonaceous material, the scattering ratio of the carbonaceous material added to the inside of the vessel can effectively be controlled.

As mentioned above, when the carbonaceous material is selected so that the particle size selected according to the standard of the above equation is held in an atmosphere temperature before the charging and the fine particulation is caused by the thermal crumbling at a higher atmosphere temperature after the charging, the surface area of the carbonaceous material existing in the vessel can be increased while controlling the scattering of the carbonaceous material toward the outside of the vessel and hence it is possible to improve the reduction reaction efficiency of the ore.

And also, the above carbonaceous material can be produced by aggregating small particle size portions of the carbon substance satisfying the aforementioned conditions.

As a refractory brick for the smelting reduction furnace, the use of MgO-C brick, particularly MgO-C brick having C≧8% is advantageous from a viewpoint of the resistance to slag oxidation and spalling. As previously mentioned, however, the erosion of MgO-C brick has hitherto been promoted by reaction between oxide in the chromium ore and C in the refractory.

On the contrary, when using the carbonaceous material according to the invention, the above problem is solved. In the invention, therefore, the MgO-C bricks having C≧8% can be used. As a result of experiments, it is possible to use MgO-C bricks having C content up to 25%. Moreover, the use of the brick exceeding the above level of C content is disadvantageous in view of the compactness being important for the abrasion resistance and the resistance to attack of oxidizing gas.

In FIG. 6 are shown results measured on a relation between C content in the brick and erosion rate of slag line (see FIG. 3).

As seen from FIG. 6, when the C content is within a range of 8–25%, preferably 13–20%, an excellent effect is obtained.

Moreover, the importances of the resistance to spalling and the resistance to attack of oxidizing gas as mentioned above differ in sites of the furnace, so that it is favorable that bricks having different C contents are properly used according to the sites.

Further, the erosion rate of the slag line becomes large as the post combustion ratio becomes high. This is due to the fact that as the post combustion ratio increases, the heat efficiency transferred to molten iron lowers and hence the surface temperature of the slag and the temperature of the waste gas rise. Under such circumstances, the oxidation of the brick through the oxide in the slag progresses.

In this connection, if coal having HGI of not more than 45 is used, the reduction rate increases and also the waste gas temperature lowers as previously mentioned, so that it is advantageous to prevent the oxidation of the brick. Even in this case, the protection of the refractory becomes still disadvantageous under a condition that the post combustion ratio is high.

In FIG. 7 are shown results investigated on a relation between post combustion ratio and erosion rate of slag line (boundary face between slag and gas phase). In this case, Vietnam coal (HGI=35, VM=5.8%) is used as the carbonaceous material, in which particle size of 6–50 mm is not less than 80%.

As seen from FIG. 7, when the post combustion ratio exceeds 30%, the erosion rate rapidly increases.

Therefore, it is favorable to conduct the operation under a condition that the post combustion ratio is not more than 30%.

From the investigated results, it is guessed that when the post combustion ratio exceeds 30%, the waste gas temperature rapidly rises and the post combustion efficiency lowers to promote the erosion of the refractory.

In the invention, the metallurgical reaction vessel is not particularly restricted, and a top-blown furnace, a bottom-blown furnace and a side-blown furnace can be used without problem, but the use of top-and bottom-blown furnace is particularly preferable.

BEST MODE FOR CARRYING OUT THE INVENTION

Example 1

Figure 8:
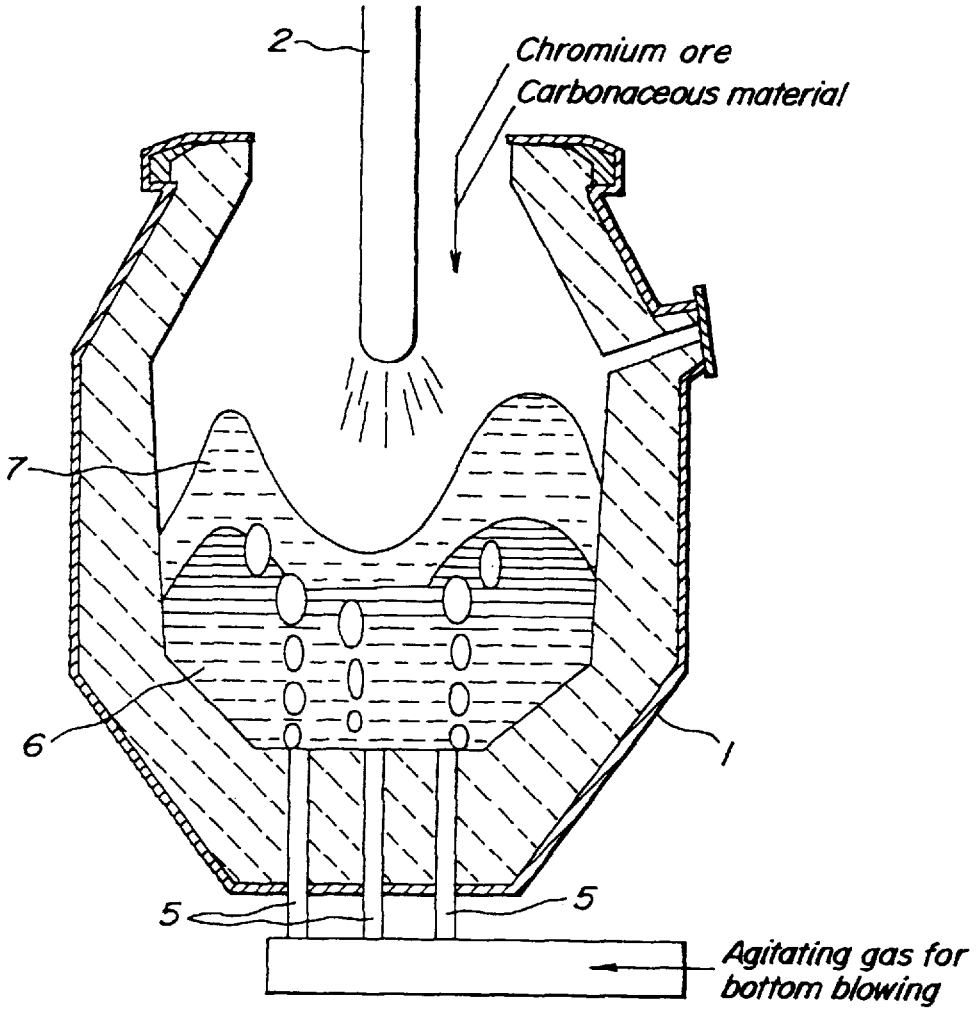
FIG. 8 is a diagrammatic view of a smelting reduction furnace used in examples.

In this example, an experiment is carried out by using top-and bottom-blown converter of 160 tons as shown in FIG. 8. In FIG. 8, numeral 5 is a bottom-blown tuyere, numeral 6 a chromium containing molten metal, and numeral 7 a slag.

The operation is conducted by charging carbonaceous material and chromium ore as shown in Table 1 into gas-agitated melt (slag and metal) from the upper side.

In this experiment, the slag has a typical composition of CaO: 59%, $SiO_2$: 22%, $Al_2O_3$: 15%, MgO: 3%, T.Fe: 0.7% and T.Cr: 0.2%, and the metal has a typical composition of C: 5.1%, Si: 0.02%, P: 0.025%, S: 0.004% and Cr: 10.5%, and a tapping temperature is 1560° C.

The presence or absence of thermal crumbling of the carbonaceous material after the charging, total surface area of the carbonaceous material per 1 ton of slag just after the completion of reduction operation, state of slag foaming and slopping, erosion amount of refractory and Cr concentration in slag after the smelting reduction are measured to obtain results as shown in Table 1.

In Table 1, case 1–3 are acceptable examples, and case 4–6 are comparative examples.

TABLE 1

| Case | Unit of chromium ore (kg/ton) | Kind of carbona-ceous material | Unit of carbona-ceous material (kg/ton) | Unit of $O_2$ ($Nm^3$/ton) | Presence or absence of thermal crumbling of carbonaceous material after the charging | Total surface area of carbonaceous material after the operation ($m^2$) | State of slag foaming and slopping | Erosion index of refractory | Cr concen-tration in slag after smelting reduction (%) | Remarks |
|---|---|---|---|---|---|---|---|---|---|---|
| 1 | 220 | anthracite | 440 | 280 | presence | 195 | none | 200 | 0.2 | Acceptable Example |
| 2 | 230 | anthracite | 448 | 295 | presence | 300 | none | 185 | 0.3 | Acceptable Example |
| 3 | 210 | anthracite | 425 | 280 | presence | 185 | none | 200 | 0.3 | Acceptable Example |
| 4 | 205 | anthracite | 465 | 285 | presence | 55 | none | 620 | 4.8 | Comparative Example |
| 5 | 212 | coke | 475 | 280 | absence | 50 | occurred, temporalily stopped | 700 | 7.2 | Comparative Example |
| 6 | 200 | coke | 440 | 280 | absence | 45 | occurred | 800 | 3.5 | Comparative Example |

*Erosion index of refractory: erosion rate when erosion rate of MgO—C brick having C = 13% is 100

As seen from Table 1, when the smelting reduction is carried out according to the invention method, there is no occurrence of slag foaming and slopping, and the erosion amount of the refractory is slight, and the Cr concentration in slag after the smelting reduction is as very low as about 0.2–0.3 wt %, so that good smelting reduction can be attained.

Furthermore, it has been confirmed that the resulting slag has no problem in the effective reutilization as roadbed member or the like.

Example 2

An experiment is carried out by using the same converter-type smelting reduction furnace shown in FIG. 8 as in Example 1. As the carbonaceous material charged, there are used anthracite having VM: 7% as an example of the invention, coke containing substantially no volatile matter and general-use coal having VM: 20% as comparative examples. As the particle size distribution, the ratio of particle size larger than that calculated from the above equation (1) is not less than 80% in the anthracite, while the comparative examples use coke and general-use coal having substantially the same particle size distribution as the anthracite.

The operation is carried out by making the oxygen feed rate, post combustion ratio and feed rate of carbonaceous material to same levels so as to generate substantially the same amounts of CO and $CO_2$ gases.

The scattering ratio of carbonaceous material and yield of chromium ore in the operation under the above conditions are measured to obtain results as shown in Table 2.

Moreover, the scattering ratio of carbonaceous material is determined by sampling dust discharged outward from the furnace, while the yield of chromium ore is determined from the amount of chromium ore charged and the chromium content in the chromium containing molten metal after the smelting reduction.

TABLE 2

| | Comparative Example 1 | Comparative Example 2 | Acceptable Example |
|---|---|---|---|
| Kind of carbonaceous material | coke | general-use coal | anthracite |
| VM (%) | <1 | 30 | 7 |
| dp (mm) | 1.0 | 1.9 | 1.2 |
| Unit of carbonaceous material (kg/ton) | 530 | 750 | 540 |
| Scattering ratio of carbonaceous material (%) | 5 | 33 | 8 |
| Yield of chromium ore (%) | 80 | 85 | 95 |
| Presence or absence of thermal crumbling | absence | presence | presence |

As seen from Table 2, the scattering ratio of carbonaceous material in the general-use coal is as greatest as 33%, while the scattering ratio in the anthracite can be controlled to the same level as in the coke or not more than 10%. As to the yield of chromium ore, the use of the anthracite shows a highest value of 95% as compared with 80–85% in the coke and general-use coal.

That is, the scattering ratio of carbonaceous material in the coke is substantially the same level as in the anthracite, but the yield of chromium ore does not extend to the same level as in the anthracite, while the scattering ratio of carbonaceous material in the general-use coal is higher than that of the anthracite and the yield of chromium ore does not extend to the same level as in the anthracite. On the contrary, when the anthracite is used as the carbonaceous material satisfying the conditions defined in the invention, the smelting reduction of chromium ore can be carried out economically and efficiently.

Example 3

Figure 1:
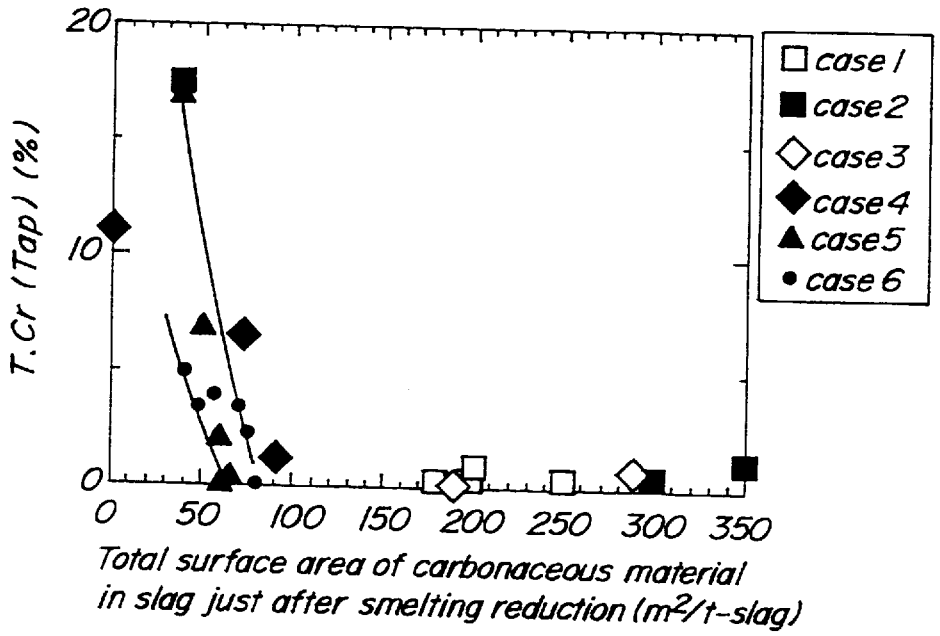
FIG. 1 is a graph showing a relation between total surface area of a carbonaceous material in slag and T.Cr in slag.
Figure 2:
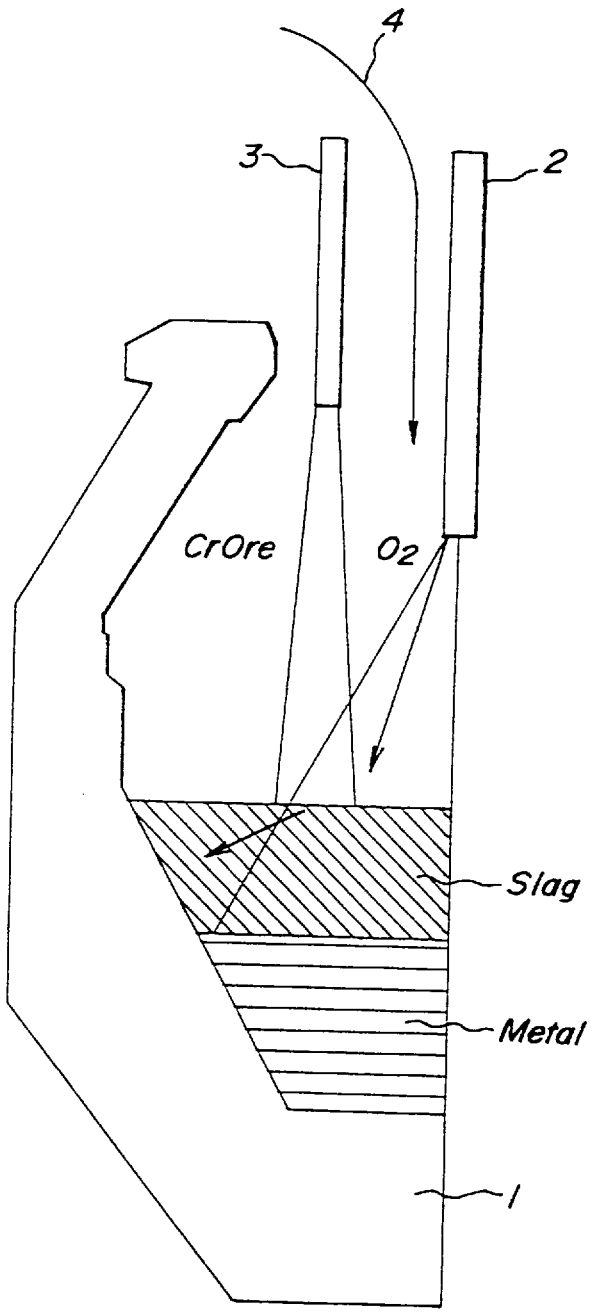
FIG. 2 is a diagrammatic view illustrating a state of descending chromium ore when the chromium ore is charged from a chromium charging lance.
Figure 3:
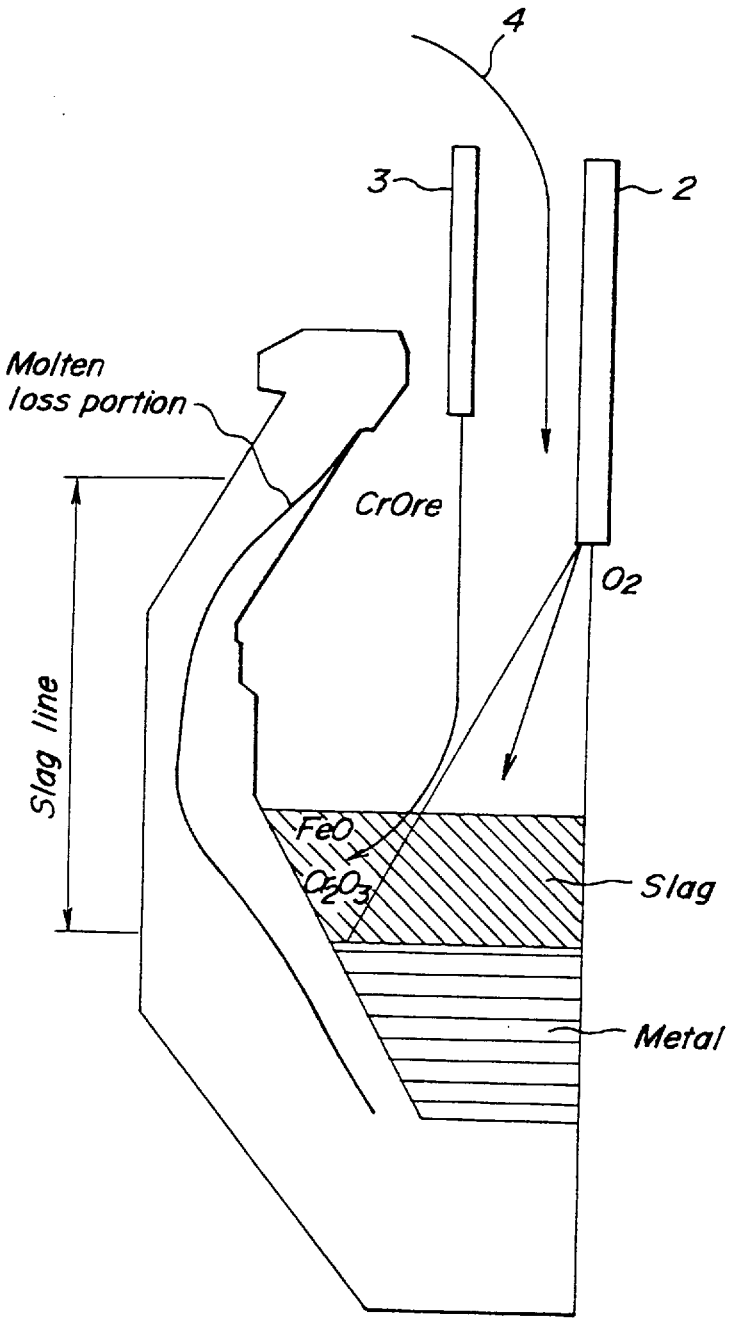
FIG. 3 is a diagrammatic view illustrating a erosion state of a refractory in a vessel wall when the chromium ore is charged by the above method.
Figure 4A:
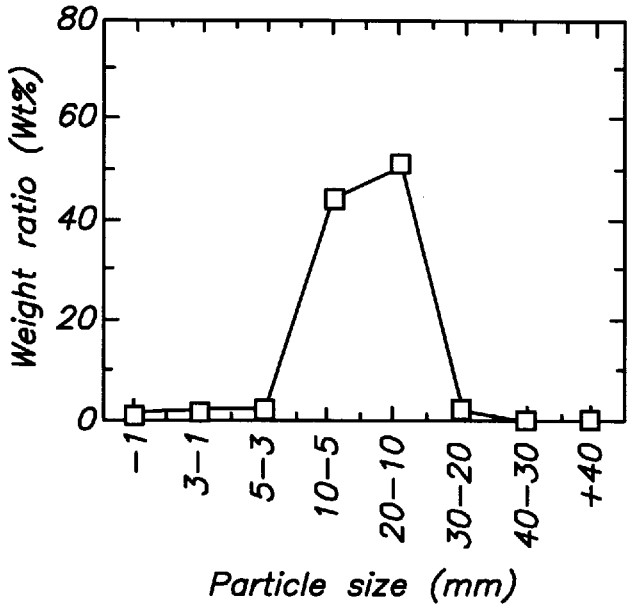
FIGS. 4(*a*), (*b*) are graphs showing a particle size distribution of carbonaceous material before and after the charging into a vessel, respectively.
Figure 4B:
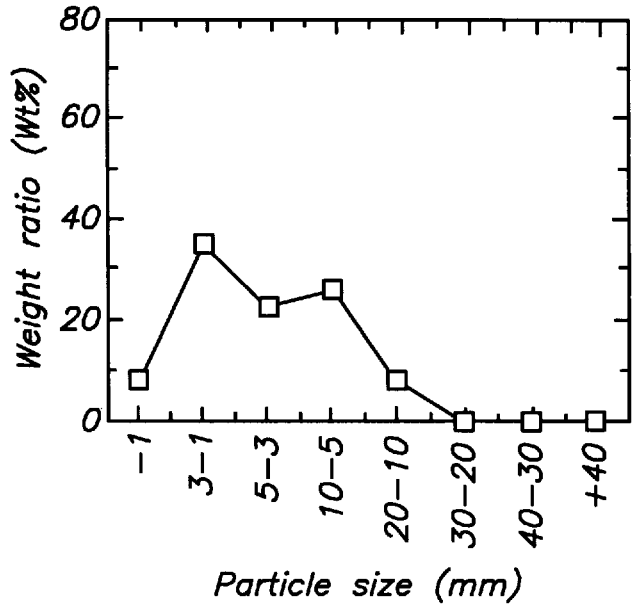
Figure 5:
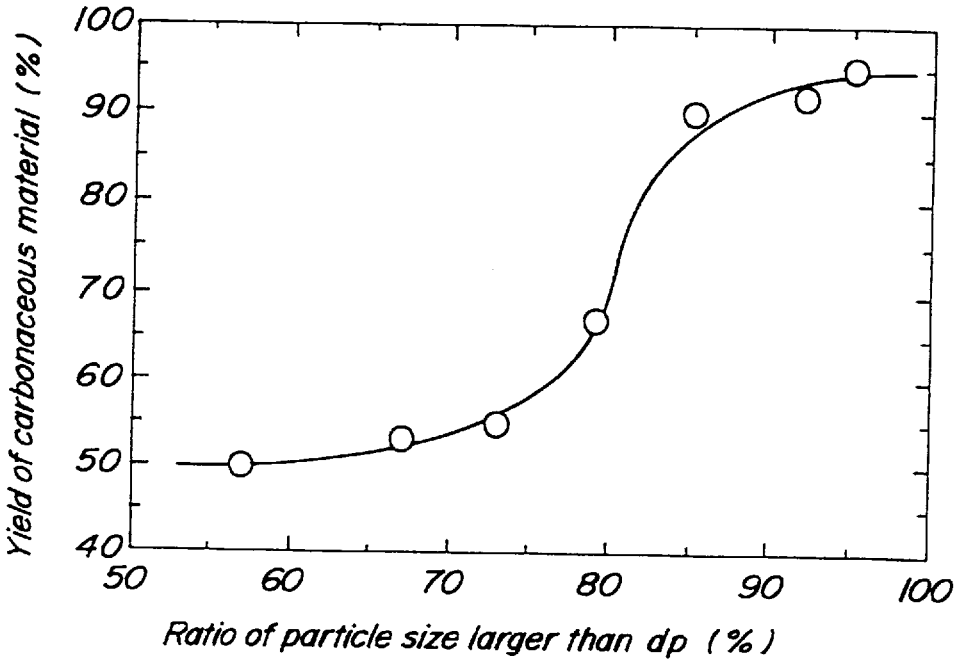
FIG. 5 is a graph showing a relation between a particle size distribution of carbonaceous material and a yield of carbonaceous material.
Figure 6:
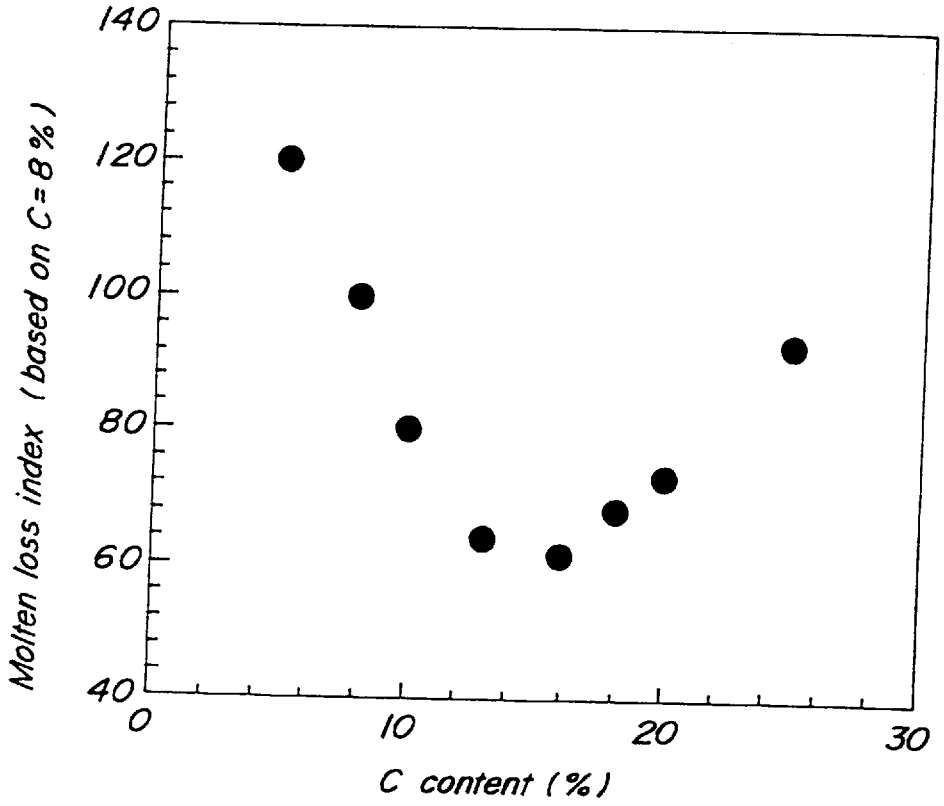
FIG. 6 is a graph showing a relation between C content in brick and erosion rate of slag line.
Figure 7:
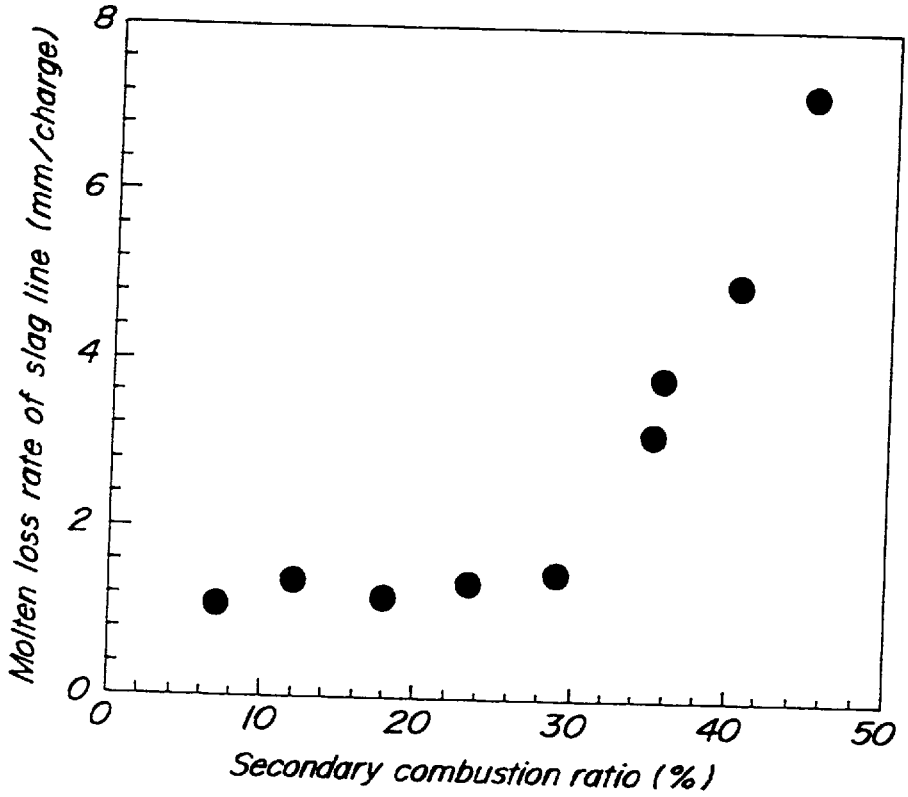
FIG. 7 is a graph showing a relation between post combustion ratio and erosion rate of slag line.

An experiment is carried out by using a top-and bottom-blown smelting reduction furnace of 150 tons. After a scrap of 30 tons is charged into the smelting reduction furnace, molten iron of 130 tons previously subjected to silicon and phosphorus removing treatment is transferred with a torpedo car and charged into the furnace. A lance for charging chromium ore and a top-blown lance for the supply of oxygen are arranged as shown in FIG. 3. MgO-C bricks having a carbon content of 13–20% are arranged in a site corresponding to a slag line.

A height of the top-blown lance 2 is 4.2 m from a static surface of molten steel, and a height of the charging lance is 5.2 m from the static surface of molten steel. The blowing is carried out under conditions that a top-blown oxygen amount is 400–800 $Nm^3$/min, a bottom-blown oxygen amount is 80 $Nm^3$/min and a bottom-blown nitrogen amount is 40 $Nm^3$/min. Various coals (A brand (Vietnam): HGI=35, VM=5.8%, B brand (Russian): HGI=38, VM=3.7%, C brand (Chinese): HGI=42, VM=9%) are supplied at a ratio of 1.60 kg/$Nm^3$—$O_2$ as a carbonaceous material until the molten metal temperature is raised from 1550° C. to 1600° C. Moreover, the carbonaceous material is used by previously sieving and removing fine particles of less than 5 mm. Therefore, the ratio of particle size of not less than 5 mm in the carbonaceous material is not less than 90% at a time of charging into a starting material feeding equipment.

At a time of arriving the molten metal temperature to a given value, the feeding of chromium ore is carried out. The feeding amount is a ratio of chromium ore: 1.35 kg/$Nm^3$—$O_2$ and carbonaceous material: 1.25–1.4 kg/$Nm^3$—$O_2$. The slag is periodically samples during the blowing and also the temperature is measured, whereby the temperature is held within a range of 1570–1600° C. The chromium concentration in the slag varies within a range of about 2–4%.

After a given time (about 70–80 minutes, the lance is raised to stop the feeding of chromium ore, and only the blowing of oxygen is further carried out for about 5–7 minutes. This operation is conducted at a post combustion ratio of about 25%. Immediately after the completion of the blowing, colemanite is charged into the furnace so as to modify the properties of the slag after the smelting reduction treatment.

Such an operation is continuously repeated by about 100 charges, during which a erosion site of the refractory is measured by means of a laser profile meter.

The obtained results are shown in Table 3.

As seen from this table, the use of the carbonaceous material according to the invention can reduce the erosion rate of the refractory to not more than 1.2 mm/ch under a high reduction reaction efficiency of chromium of not less than 89%.

TABLE 3

| | Acceptable Example | | | Comparative Example | | | | | | |
|---|---|---|---|---|---|---|---|---|---|---|
| | 1 | 2 | 3 | 1 | 2 | 3 | 4 | 5 | 6 | 7 |
| Kind of carbonaceous material | A brand | B brand | C brand | A brand | A brand | D brand | E brand | F brand | G brand | Coke |
| HGI | 35 | 38 | 42 | 35 | 35 | 49 | 75 | 68 | 70 | — |
| VM | 5.8 | 3.7 | 9 | 5.8 | 5.8 | 9.9 | 18 | 20 | 25 | — |
| Chromium ore (kg/t) | 350 | 350 | 350 | 350 | 350 | 350 | 350 | 350 | 350 | 350 |
| Reduction reaction efficiency of chromium (%) | 92 | 91 | 89 | 92 | 92 | 89 | 77 | 72 | 68 | 72 |
| Post combustion ratio (%) | 25 | 24 | 27 | 35 | 45 | 27 | 19 | 21 | 24 | 23 |
| Maximum erosion rate of slag line (mm/ch) | 1.3 | 1.4 | 1.5 | 3.8 | 7 | 4 | 4.5 | 4.3 | 5 | 5 |
| Average erosion rate of slag line (mm/ch) | 1.2 | 1.1 | 1.2 | 2.7 | 4.5 | 1.9 | 2 | 2.1 | 1.8 | 1.7 |

As Comparative Examples 1–2, the operation is carried out in the same manner as in the acceptable example except that the post combustion ratio is raised to 35% and 45%, respectively.

In this case, the reduction reaction efficiency of chromium is improved, but the erosion of the refractory in the slag line is considerably caused.

In Comparative Examples 3–7, D brand (Chinese, HGI=49, VM=9.9%), E brand (Russian, HGI=75, VM=18%), F brand (Australian, HGI=68, VM=20%), G brand (Australian, HGI=70, VM=25%) and blast furnace coke are used as a carbonaceous material, respectively. The operation conditions are the same as in the acceptable example. However, the charging coefficient in the coke is the same as in the use of the aforementioned coal, but in case of using the Russian and Australian coals, the operation is difficult unless the charging is 1.8 kg/$Nm^3$—$O_2$ at the temperature rising period and 1.6 kg$Nm^3$—$O_2$ at the smelting reduction period from a viewpoint of the resistance to slopping and temperature control.

Moreover, it is attempted to use general-use coal (HGI=40, VM=30%), but the scattering into the dust is large and the operation is actually impossible.

In Comparative Examples 3–7, the continuous operation of about 80 charges is carried out, during which the erosion site of the refractory is measured by means of a laser profile meter. As a result, a large erosion portion is locally existent in a tapping side located at the side of the lance for supplying chromium ore and hence it is obliged to repair such a portion.

And also, the reduction reaction efficiency of chromium is degraded.

INDUSTRIAL APPLICABILITY

According to the invention, the reduction reaction efficiency of molten slag, which was a greatest problem in the conventional smelting reduction, can largely be improved, so that it is possible to conduct the smelting reduction in a high efficiency, which has a great industrial merit.

Further, according to the invention, the smelting reduction can stably be carried out by utilizing the thermal crumbling action of the carbonaceous material under a high-temperature atmosphere while controlling the scattering of the carbonaceous material, and also a great effect is developed even in the decrease of molten refractory loss and the effective utilization of slag.

We claim:

1. A smelting reduction process of chromium ore by charging a carbonaceous material and a chromium ore into hot metal admitted in a metallurgical reaction vessel such as a converter or the like, feeding an oxygen gas to burn the carbonaceous material and conducting fusion and reduction of the chromium ore through heat of combustion to produce a chromium-containing molten metal, wherein a carbon substance having a Hardgrove grindability index (HGI) of not more than 45 and a volatile matter (VM) of not more than 10% is finely particulated by thermal crumbling after charging and is used as the carbonaceous material.

2. A smelting reduction process according to claim 1, wherein the carbonaceous material charged in the metallurgical reaction vessel is finely particulated by thermal crumbling after charging and has such a particle size formation that a ratio of particle size larger than a given particle size (dp) calculated from the following equation (1) is not less than 80%:

$$dp=0.074\cdot((Q+0.04\cdot VM\cdot W)/D^2)^{2/3}\ (mm) \quad (1)$$

wherein VM: volatile matter in carbonaceous material (%)

W: feed rate of carbonaceous material (kg/min)

Q: rate of generating ($CO+CO_2$) from an inside of a vessel resulted from the supply of oxygen ($Nm^3$/min)

D: opening diameter of a vessel (m).

3. A smelting reduction process according to claim 1 or 2, wherein the carbonaceous material is charged into the metallurgical reaction vessel in an amount that a total surface area of the carbonaceous material charged is not less than 60 $m^2$ per 1 ton of slag existing in the vessel.

4. A smelting reduction process according to claim 2, wherein a portion of the carbonaceous material having a particle size smaller than the particle size calculated by the equation (1) is agglomerated.

5. A smelting reduction process according to claim 1 or 2, wherein the reaction vessel is a converter using MgO-C bricks having a C content of 8–25% in at least a part of a portion of the vessel contacting with the slag.

6. A smelting reduction process according to claim 1 or 2, wherein a post combustion ratio inside the reaction vessel is not more than 30%.

7. A smelting reduction process according to claim 3, wherein the reaction vessel is a converter using MgO-C bricks having a C content of 8–25% in at least a part of a portion of the vessel contacting with the slag.

8. A smelting reduction process according to claim 4, wherein the reaction vessel is a converter using MgO-C bricks having a C content of 8–25% in at least a part of a portion of the vessel contacting with the slag.

9. A smelting reduction process according to claim 3, wherein a post combustion ratio inside the reaction vessel is not more than 30%.

10. A smelting reduction process according to claim 4, wherein a post combustion ratio inside the reaction vessel is not more than 30%.

11. A smelting reduction process according to claim 5, wherein a post combustion ratio inside the reaction vessel is not more than 30%.

12. A smelting reduction process according to claim 3, wherein the reaction vessel is a converter using MgO-C bricks having a C content of 8–25% in at least a part of a portion of the vessel contacting with the slag, and wherein a post combustion ratio inside the reaction vessel is not more than 30%.

13. A smelting reduction process according to claim 4, wherein the reaction vessel is a converter using MgO-C bricks having a C content of 8–25% in at least a part of a portion of the vessel contacting with the slag, and wherein a post combustion ratio inside the reaction vessel is not more than 30%.

14. A smelting reduction process of chromium ore by charging a carbonaceous material and a chromium ore into hot metal admitted in a metallurgical reaction vessel such as a converter or the like, feeding an oxygen gas to burn the carbonaceous material and conducting fusion and reduction of the chromium ore through heat of combustion to produce a chromium-containing molten metal, wherein a carbon substance having a Hardgrove grindability index (HGI) of not more than 45 and a volatile matter (VM) of not more than 10% is finely particulated by thermal crumbling after charging and is used as the carbonaceous material, wherein the carbonaceous material charged in the metallurgical reaction vessel is finely particulated by thermal crumbling after charging and has such a particle size formation that a ratio of particle size larger than a given particle size (dp) calculated from the following equation (1) is not less than 80%:

$$dp=0.074\cdot((Q+0.04\cdot VM\cdot W)/D^2)^{2/3}\ (mm) \quad (1)$$

wherein VM: volatile matter in carbonaceous material (%)

W: feed rate of carbonaceous material (kg/min)

Q: rate of generating ($CO+CO_2$) from an inside of a vessel resulted from the supply of oxygen ($Nm^3$/min)

D: opening diameter of a vessel (m), wherein the carbonaceous material is charged into the metallurgical reaction vessel in an amount that a total surface area of the carbonaceous material charged is not less than 60 $m^2$ per 1 ton of slag existing in the vessel, wherein a portion of the carbonaceous material having a particle size smaller than the particle size calculated by the equation (1) is agglomerated, wherein the reaction vessel is a converter using MgO-C bricks having a C content of 8–25% in at least a part of a portion of the vessel contacting with the slag, and wherein a post combustion ratio inside the reaction vessel is not more than 30%.

* * * * *